US005842252A

United States Patent [19]

Cameron et al.

[11] Patent Number: 5,842,252

[45] Date of Patent: Dec. 1, 1998

[54] PIPE WIPER SYSTEM

[75] Inventors: James R. Cameron, Nueces County; Benton F. Baugh, Harris County, both of Tex.

[73] Assignee: Cameron Equipment Co., Corpus Christi, Tex.

[21] Appl. No.: 406,747

[22] Filed: Mar. 20, 1995

[51] Int. Cl.[6] ..... E21B 33/08

[52] U.S. Cl. ..... 15/256.5; 15/104.04; 15/256.6; 166/84.1; 175/84

[58] Field of Search ..... 15/102, 104.04, 15/220.4, 256.5, 256.6; 166/84.1; 175/84

[56] References Cited

U.S. PATENT DOCUMENTS

| | | | |
|---|---|---|---|
| 1,641,921 | 9/1927 | Crowell | 15/220.4 |
| 2,026,036 | 12/1935 | Head | 15/256.6 |
| 2,113,529 | 4/1938 | Hild | 175/84 |
| 2,480,371 | 8/1949 | Kalhoefer | 15/104.04 |
| 2,718,021 | 9/1955 | Baebel | 15/220.4 |
| 2,809,012 | 10/1957 | Stevens | 175/84 |
| 3,733,641 | 5/1973 | Brown | 15/220.4 |
| 4,457,366 | 7/1984 | Brown | 15/104.04 |
| 4,690,213 | 9/1987 | Stannard et al. | 166/84.1 |
| 4,982,787 | 1/1991 | Reddoch | 175/84 |

*Primary Examiner*—Mark Spisich

[57] ABSTRACT

A pipe wiper assembly for stripping fluid from oil and gas well strings which has a pair of rams which can move from a first remote position relative to the pipe forward to a second position contacting and wiping the pipe and forward to a third position when the pipe is not in the oil or gas well to protectively cover the well, the rams being mounted in a carrier which has freedom of movement in any radial direction to allow the rams to be centralized around the oil or gas well string. The unit having alignment guides such that when the rams are returned to the first position the rams and carrier will be centralized over the well bore and the freedom of radial movement is eliminated.

18 Claims, 6 Drawing Sheets

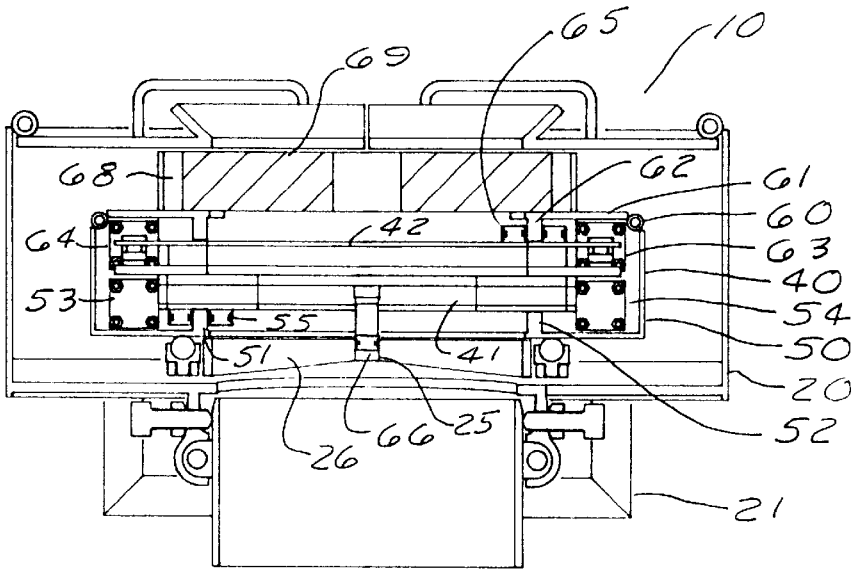
FIG. NO. 2
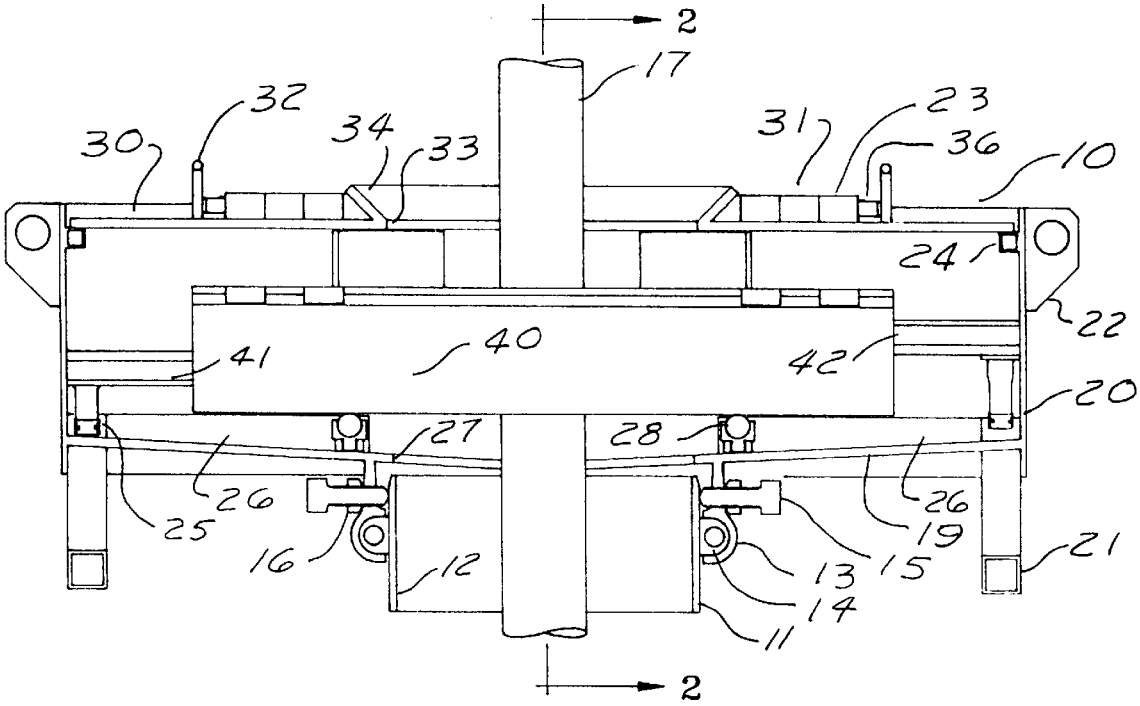
FIG. NO. 1

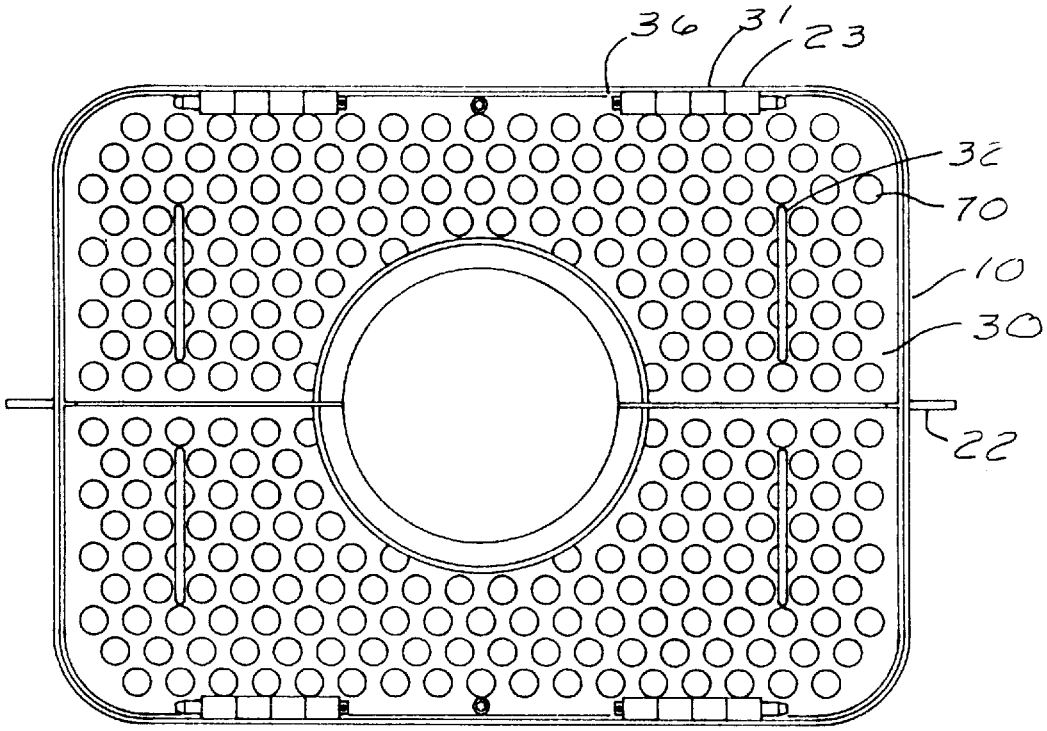
FIG. NO. 3
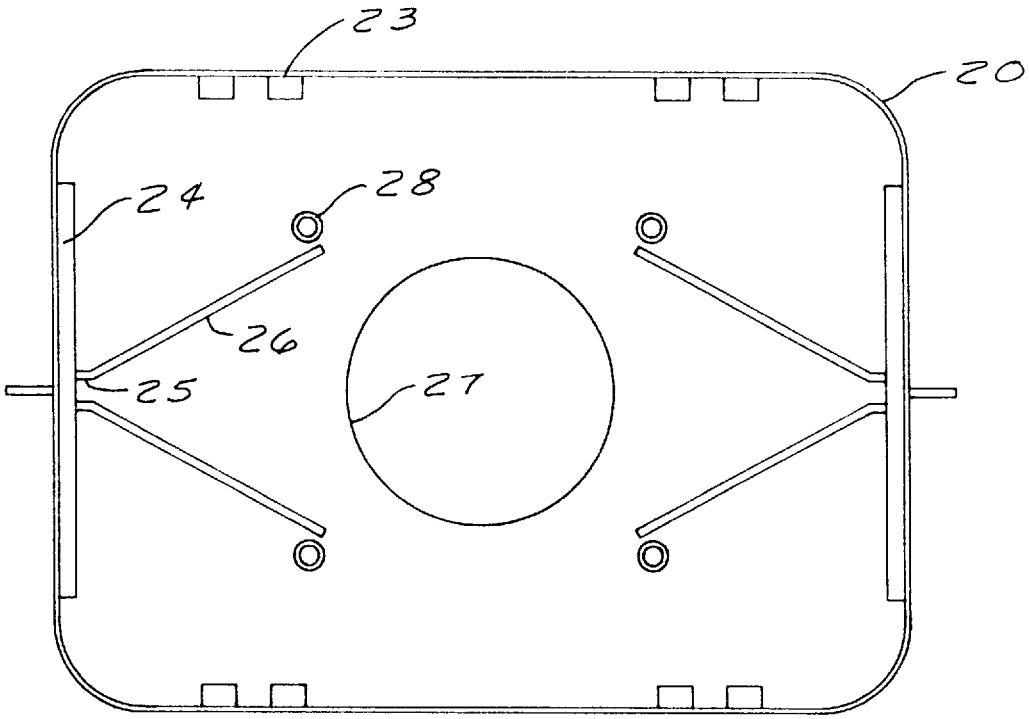
FIG. NO. 4

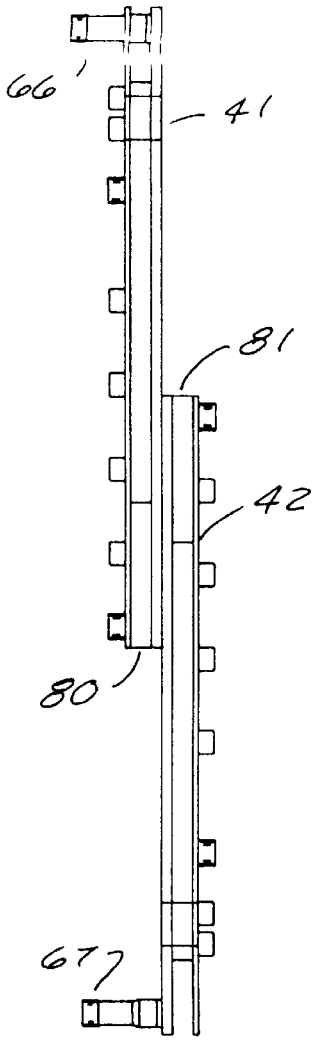
FIG. NO. 7
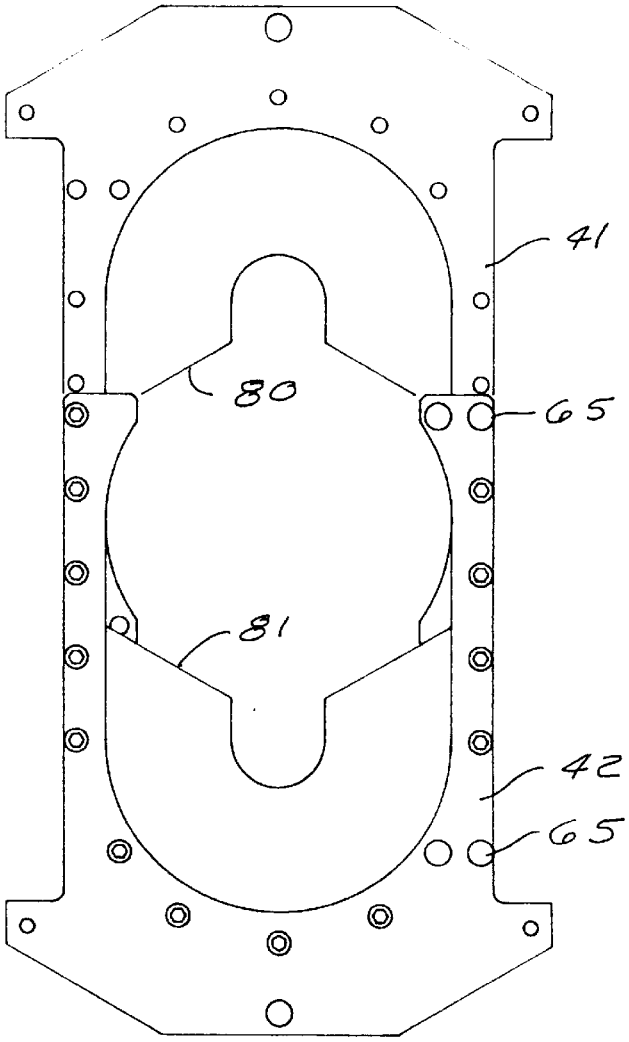
FIG. NO. 5
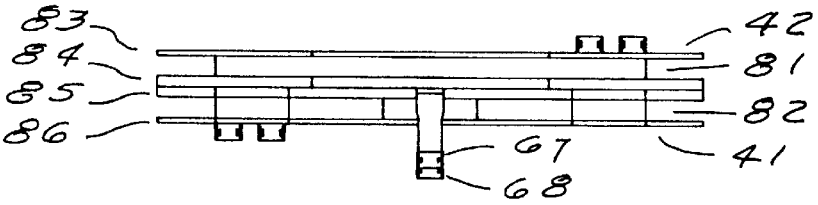
FIG. NO. 6

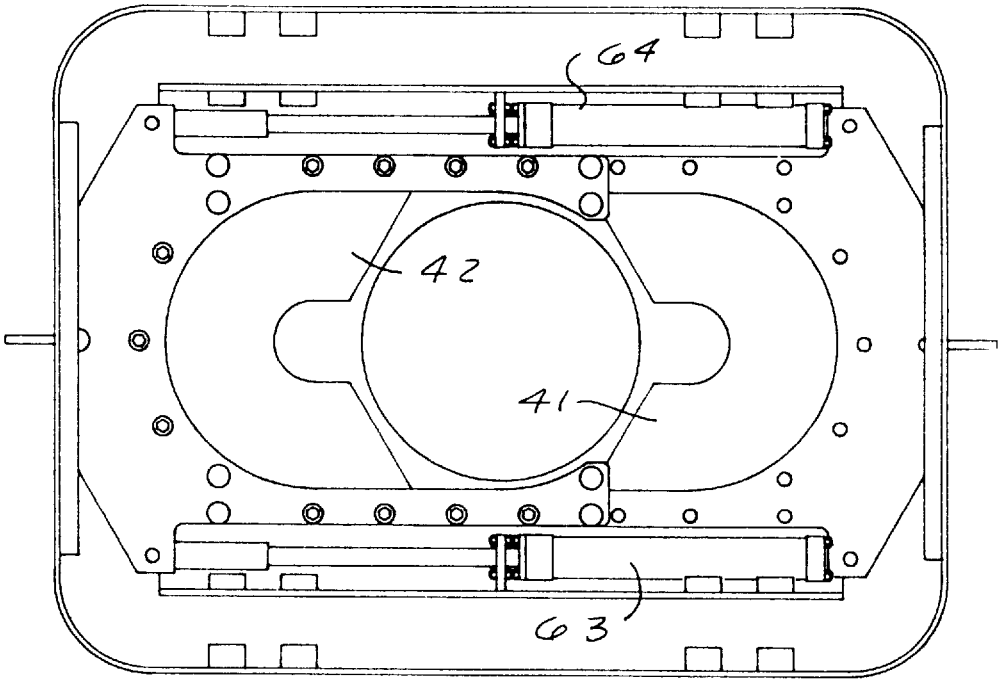
FIG. NO. 8
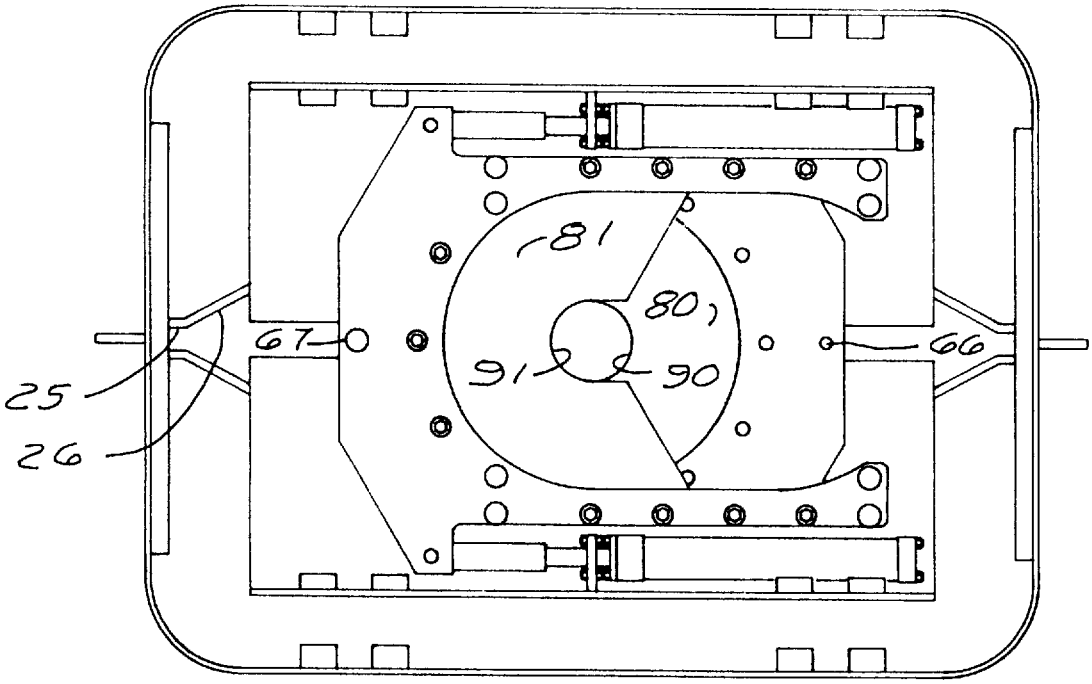
FIG. NO. 9

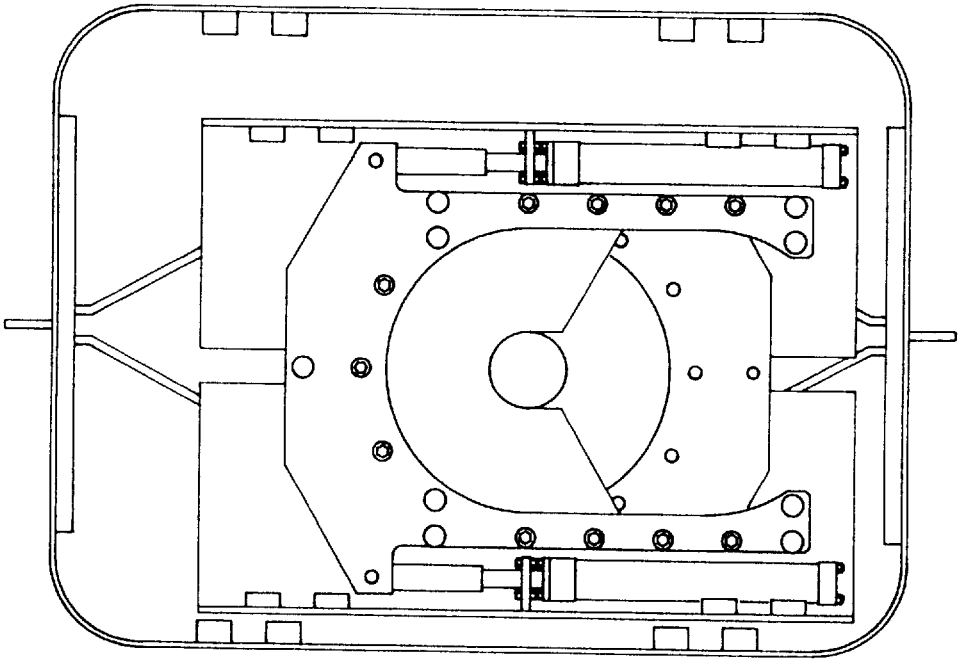
FIG. NO. 10
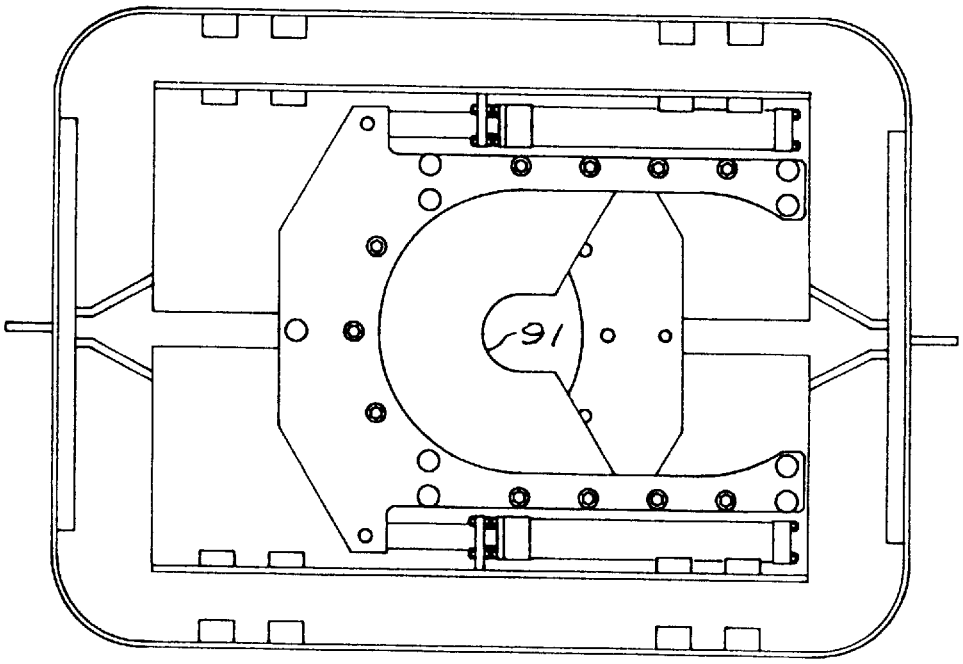
FIG. NO. 11

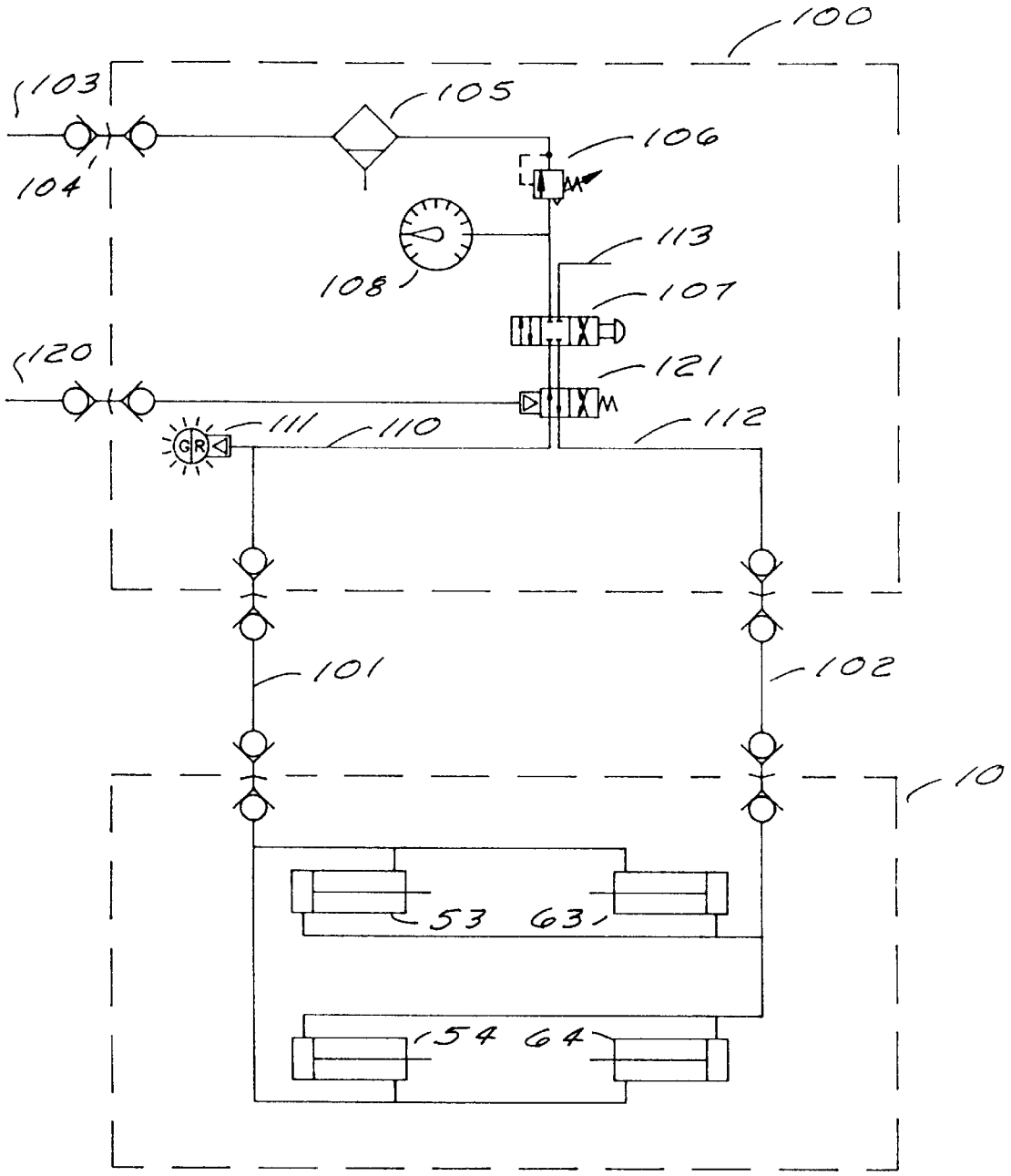
FIG. NO. 12

PIPE WIPER SYSTEM

BACKGROUND OF THE INVENTION

When a pipe string is pulled from a fluid filled well, some fluid clings to the outer surface of the string, or pipe. The pipe is separated into selected lengths for handling and usually stands vertically on the rig floor, extending up into the derrick, until reassembled and put back into the well. The fluid drips down on the rig floor to create waste, hazard and pollution. It has, for years, been a practice to use some means to strip the fluid from the pipe surface as the string moves upward through the drilling floor and to direct the recovered fluid back to the fluid handling system.

The pipe wiper system is commonly placed below the drilling floor, and above the well head. The well head is usually fitted with a funnel opening upwardly near the wipers to gather the stripped fluid. Some pipe wipers are simple bushings of resilient material that snugly fit the pipe but are sufficiently resilient to stretch over tool joints moving upward while the bushing is tethered to the structure. Such bushings have to be removed for the passage of stabilizers and other large components of the string.

Other pipe wipers have laterally movable arcuate wiper blades that can be forced against the pipe for wiping action or moved away to clear the string. Such wiper blades are resilient and shaped to overlap when against the pipe. To permit overlap, the blades are usually spaced apart vertically. Such wiper systems are usually fluid powered for opening and closing on the pipe, with the fluid power controlled by valves accessible to personnel on the rig floor.

The drill string, when suspended from the hook, usually moves radially around the interior of the larger well bore. The pipe wiper must accept this lateral movement and still perform as intended.

The laterally moveable blades are typically mounted on some type of carrier which maintains the moveable blades as a group during the radial movement. A central hole thru the carrier and the moveable blades must be large enough to allow a full access to the well bore when the blades are laterally retraced and the carrier is radially moved off the center of the well bore. If the radial movement allowed is 4" in any direction and the well bore is 16", then the hole thru the carrier assembly must be 24". This large hole size makes all parts larger, and makes the lateral movement of the blades 4" more than it might otherwise be.

An additional problem with existing pipe wipers is that rotational movement of the pipe can occur and cause heating, wear, and damage to the resilient blades if the drilling supervisor does not think to open the blades to a position away from the pipe.

It is therefore an object of this invention to provide a pipe wiper assembly in a containing funnel, attachable to the well head, within which a wiper blade assembly can move laterally in a sympathy with movement of the pipe string.

It is a second object of this invention to provide a pipe wiper assembly which is automatically centered about the well bore when it is retracted away from the pipe string to provide a full open bore into the well bore without an oversized hole through the carrier.

It is a further object of this invention to provide a pipe wiper assembly that is compact and responsive to fluid power control manipulations to open the wiper to clear the pipe string and to close the wiper to strip fluid from the pipe.

It is a further object of this invention to provide a pipe wiper which will automatically retract away from the pipe when rotational pipe string movement occurs.

BRIEF DESCRIPTION OF THE DRAWINGS

FIG. 1 is a partial section thru a pipe wiper.

FIG. 2 is a half section thru the pipe wiper of FIG. 1 taken along lines "2—2", and with the pipe string deleted.

FIG. 3 is a top view of the pipe wiper.

FIG. 4 is a to view of the pipe wiper with the doors, carrier, and sealing rams removed to show the alignment guides in the bottom of the assembly.

FIG. 5 is a top view of the wiping rams.

FIG. 6 is an end view of the wiping rams.

FIG. 7 is a side view of the wiping rams.

FIG. 8 is a top view of the pipe wiper with the doors removed above the wiping rams, and the wiping rams retracted to a full bore position.

FIG. 9 is the view of FIG. 8 with the wiping rams moved to the position at which they would be wiping against a pipe string in the well.

FIG. 10 is the view of FIG. 9 with the carrier and wiping rams moved to a radially offset position such as would be the case when the pipe string were hung eccentrically in the well.

FIG. 11 shows the wiping rams moved to their full forward position and completely closing off the well as it would be when there was no pipe in the well and the unit was providing the service of preventing tools from being dropped into the well.

FIG. 12 is a representative plumbing schematic of the pipe wiper and control panel.

DESCRIPTION OF THE PREFERRED EMBODIMENT

Referring now to FIG. 1, FIG. 1 is approximately a half section thru a pipe wiper 10 mounted on a pipe 11 coming up from the well bore. Pipe wiper 10 is secured to pipe 11 having a bore 12 by a coupling 13 with seal 14, bolt 15, and lock nut 16. Pipe string 17 is shown passing thru the pipe wiper 10. It is this pipe which will be wiped clean of drilling mud when it is pulled up out of the drilling mud filled bore of the oil or gas well. Coupling 13 is fixed to sloping floor 19 of base 20 which has landing legs 21, lifting eyes 22, hinges 23, lid shoulder 24, straight alignment guides 25, funnel guides 26, thru bore 27, and carrier supports 28. Lid 30 has hinge piece 31, lifting eyes 32, thru bore 33, and upper funnel 34. Removable hinge pins 36 attach the lid 30 to the base 20.

Carrier 40 contains lower ram 41 and upper ram 42.

FIG. 2 shows a half section of FIG. 1 taken along lines 2—2 of and shows upper ram 42 stacked on lower ram 41. Carrier 40 has a carrier base 50 with guide rails 51 and 52 which support the lower ram 41 and therefore the upper ram 42. Lower ram 41 connects to cylinders 53 and 54 to provide lateral movement and has guide bearings 55 which guide the lateral movement. Carrier 40 also has a hinge 60 which connects to top plate 61 which in turn has guide rail 62. Upper ram 42 connects to cylinders 63 and 64 to provide lateral movement and has guide bearings 65 which guide the lateral movement.

Alignment post 66 is shown depending from lower ram 41 having been guided by the funnel guides 26 and into the straight alignment guides 25. Upper ram 42 has a similar alignment post 67 which in like manner guides the upper ram 42 to a middle position when it is moved away from the well bore. A special cavity 68 has been prepared in the upper section of the pipe wiper 10 for the insertion of donut seal ring 69. The donut seal ring 69 can be provided as a backup for the primary wiper blades of the pipe wiper assembly. As will be seen, the mounting of donut seal ring 69 on the carrier 40 with its radial movement capability will allow that same capability for the donut seal ring 69 also.

FIG. 3 shows a top view of the pipe wiper system with the lids 30 in place and showing a multiplicity of holes 70 in the lids 30 to allow any drilling mud which lands on the top of the lid to easily fall into the base 20, down to sloping floor 19, and into the pipe bore 12.

FIG. 4 shows the base 20 with the internal parts removed. The geometry of the straight alignment guides 25 and the funnel guides 26 can be readily appreciated and their use in centralizing the position of the alignment posts 66 and 67 as they are moved toward the ends of the base 20 can be readily seen.

FIG. 5 shows a top view of the lower ram 41 having a flexible wiper blade 80 and the upper ram 42 having a flexible wiper blade 81.

FIG. 6 shows an end view of the upper ram 42 having outer plate 83, flexible wiper blade 81, inner plate 84, and alignment post 67 and lower ram 41 having inner plate 85, flexible wiper blade 80 outer plate 86 and alignment post 66.

FIG. 7 shows an additional side view of lower ram 41 and upper ram 42.

FIG. 8 shows the pipe wiper 10 with the lids 30 and top plate 61 removed for clarity. Cylinders 63 and 64 are filly extended to move upper ram 42 to its end position such that alignment post 67 is guided within straight alignment guides 25. In like manner, cylinders 53 and 54 will have extended the lower ram 41 to its guided position.

FIG. 9 shows that the cylinders 53, 54, 63, and 64 are partially retracted to move lower ram 41 and upper ram 42 to positions such that the arcuate portions 90 and 91 of flexible wiper blades 80 and 81 form an approximate circle to wipe a circular pipe string (not shown) in the well bore. It can be seen that the alignment posts 66 and 67 are no longer within the straight alignment guides 25, but are now within the funnel alignment guides 26, allowing radial movement of the assembly.

FIG. 10 shows that the carrier 40 is moved to a radially offset position as might occur if the pipe string in the well bore is not concentric with the well bore. This freedom of movement is allowed by the alignment posts not being constrained by being in positions within the straight alignment guides. As can be readily understood, if the cylinders 53, 54, 63, and 64 are extended to their original position, the alignment posts will be guided by the funnel guides 26 into the straight alignment guides 25 thereby recentralizing the carrier 40 over the well bore 12.

FIG. 11 shows that if there is no pipe in the bore, the lower ram 41 and the upper ram 42 can continue their forward travel until the arcuate portions 90 (not shown) and 91 cross and completely close the bore. This safety feature prevents loose objects from falling into the bore when the pipe string is not in the well.

FIG. 12 shows a schematic of the controls of the system with control panel 100 being interconnected to the pipe wiper 10 by hoses 101 and 102. Air supply 103 enters the control panel 100 thru quick disconnect 104, thru filter 105, air regulator 106, and to manual control valve 107. The regulated air pressure is displayed on gage 108. When the manual control valve 107 is pulled to the right to the "automatic" position, air pressure is delivered along line 110 to the rod side of the cylinders, retracting the upper and lower ram toward the pipe for wiping operations. When line 110 is pressurized, air activated visual indicator 111 is activated to indicate that the unit has been operated. When line 110 is pressurized, line 112 from the opposite end of the cylinders is vented thru line 113.

When an air signal is delivered along line 120 from a source such as the pipe rotating clutch or a mud pump clutch to the control valve 121, the control valve 121 shifts and reverses the flow along the lines. This provides protection for the flexible wiper blades such that when the pipe string begins to rotate or the pumps start, the rams automatically retract. Normally rotation is not associated with vertical movement of the pipe to necessitate wiping operations.

At any time the operating personnel can push the manual control valve 107 to the left and reverse the connection of the air lines to the cylinders to open the rams when they are closed or close the rams when they are open.

The foregoing disclosure and description of this invention are illustrative and explanatory thereof, and various changes in the size, shape, and materials as well as the details of the illustrated construction may be made without departing from the spirit of the invention.

We claim:

1. An assembly for stripping liquid from the external surface of a tubular article being pulled from a well, comprising an elongated housing having a bottom including a first opening allowing for the vertical passage of said tubular article therethrough and a first and second housing guidance means;

a carrier having a second opening therethrough and being mounted for movement in the housing between a first position where the first and second openings are generally aligned and a second position where the first and second openings are eccentric and laterally offset from the central longitudinal axis of the housing;

first and second wiper rams mounted on the carrier for movement between a closed position for stripping liquid from the tubular article as it is pulled from the well and an open position, and further wherein each of said first and second wiper rams has a ram guidance means which is adapted to cooperate with a respective one of said first and second housing guidance means;

at least one actuator for moving said first and second wiper rams between said open and said closed positions; and said ram guidance means and said housing guidance means cooperate in such a manner whereby movement of said wiper rams toward said open position causes said carrier to be moved to said first position.

2. The invention of claim 1, wherein each said first and second housing guidance means comprises converging guide walls.

3. The invention of claim 2, wherein the converging guide walls terminate in parallel guide walls.

4. The invention of claim 1, wherein said ram guidance means is a post extending from each of said wiper rams to a position of being guided by the respective housing guidance means.

5. The invention of claim 4, wherein each said post contains low friction bearing means.

6. The invention of claim 1 wherein converging guide rails are provided as the housing guidance means at each end of said housing and ram guidance posts are provided at an outer end of said first and second wiper rams such that when said first and second wiper rams move to said open position the guidance of said converging guide rails and said ram guidance posts will align said second opening over said first opening.

7. The invention of claim 1, wherein said first and second wiper rams can move forward to a third position completely covering the first and second opening and thereby preventing the accidental dropping of objects thru said openings when said tubular article is not extending through said assembly.

8. An assembly for stripping liquid from the external surface of a tubular article being pulled from a well, comprising a housing for mounting to equipment on said well and having a bottom including a first opening allowing for the vertical passage of said tubular article therethrough;

a carrier having a second opening therethrough and being mounted for movement in the housing between a first position where the first and second openings are generally aligned and a second position where the first and second openings are eccentric;

upper and lower wiper rams mounted on the carrier for movement between a closed position for stripping liquid and, the tubular article as it is pulled from the well and an open position;

at least one actuator mounted on said carrier for moving said upper and lower wiper rams between said open and closed positions; and means on said rams and said housing which cooperate in such a manner whereby movement of said wiper rams toward said open position causes said carrier to be moved to said first position.

9. The invention of claim 8, wherein said carrier has guide rails and said upper and lower wiper rams have guidance means to interact with said guide rails to direct the movement of said upper and lower wiper rams between said open and closed positions.

10. The invention of claim 9, wherein said guide rail to direct the movement of said upper wiper ram is above said upper wiper ram and wherein said guide rail to direct the movement of said lower wiper ram is below said lower wiper ram.

11. The invention of claim 9, wherein said guidance means on said upper and lower wiper rams is a first pair of guide bearings on each side of said guide rails and a second pair of guide bearings on each side of said guide rails in a spaced apart relationship with respect said first pair.

12. The invention of claim 11, wherein said guide bearings are cam follower bearings.

13. The invention of claim 8, further comprising a donut type seal ring supported by said carrier.

14. An assembly for stripping liquid from the external surface of a tubular article being pulled from a well, comprising a housing for mounting to equipment on said well and having a bottom including a first opening allowing for the vertical passage of said tubular article therethrough;

a carrier having a second opening therethrough and being mounted for movement in the housing between a first position where the first and second openings are generally aligned and a second position where the first and second openings are eccentric;

wiper rams mounted on the carrier for movement between a closed position for stripping liquid from the tubular article as it is pulled from the well and an open position;

at least one actuator mounted on said carrier for moving said wiper rams between said open and closed positions;

means on said rams and said housing which cooperate in such a manner whereby movement of said wiper rams toward said open position causes said carrier to be moved to said first position;

said at least one actuator having a first actuator end and a second actuator end; and a fluid signal being directed to said first actuator end to move said wiper rams toward said closed position and said fluid signal being directed to said second actuator end to move said wiper rams to said open position.

15. The invention of claim 14 further comprising a manually operated valve to direct said fluid signal alternately from said first actuator end to move said wiper rams toward said closed position and to said second actuator end to move said wiper rams to said open position.

16. The invention of claim 15 further comprising a signal responsive control valve to switch said fluid signal from said first actuator end to said second actuator end in response to an input signal.

17. The invention of claim 16, wherein said input signal is a fluid signal.

18. The invention of claim 17, wherein said input signal is the fluid signal used to actuate a clutch on a well rig.

* * * * *